US005848878A

United States Patent [19]

Conti et al.

[11] Patent Number: 5,848,878

[45] Date of Patent: Dec. 15, 1998

[54] PUMP WITH IMPROVED MANIFOLD

[75] Inventors: Michael Conti, Bryan, Ohio; James Timothy Carr, Roanoke, Va.

[73] Assignee: Ingersoll-Rand Company, Woodcliff Lake, N.J.

[21] Appl. No.: 670,791

[22] Filed: Jun. 21, 1996

[51] Int. Cl.[6] ..... F04B 17/00

[52] U.S. Cl. ..... 417/393; 417/536

[58] Field of Search ..... 417/239, 238, 417/536, 393; 285/12

[56] References Cited

U.S. PATENT DOCUMENTS

| | | | |
|---|---|---|---|
| 9,854 | 7/1853 | White | 417/536 |
| D. 370,488 | 6/1996 | Kozumplik, Jr. et al. | D15/7 |
| 622,693 | 4/1899 | Jacomet | 417/536 |
| 3,567,258 | 3/1971 | Scaramucci | 285/334.4 |
| 4,623,303 | 11/1986 | Henderson | 417/238 |
| 4,661,041 | 4/1987 | Hessler | 415/52 |
| 4,691,740 | 9/1987 | Svetlik et al. | 138/109 |
| 4,712,812 | 12/1987 | Weir, III | 285/177 |
| 4,872,816 | 10/1989 | Fetcko | 417/360 |
| 4,895,494 | 1/1990 | Gardner | 417/239 |
| 4,936,753 | 6/1990 | Kozumplik, Jr. et al. | 417/238 |
| 5,108,270 | 4/1992 | Kozumplik, Jr. | 417/393 |
| 5,507,628 | 4/1996 | Masse et al. | 417/360 |
| 5,551,847 | 9/1996 | Gardner et al. | 417/393 |
| 5,567,118 | 10/1996 | Grgurich et al. | 417/46 |
| 5,711,658 | 1/1998 | Conti et al. | 417/393 |

FOREIGN PATENT DOCUMENTS

| | | | |
|---|---|---|---|
| 1196161 | 6/1970 | United Kingdom | F16L 25/00 |
| 1503722 | 3/1978 | United Kingdom | F16L 23/00 |

*Primary Examiner*—Timothy Thorpe
*Assistant Examiner*—Ehud Gartenberg
*Attorney, Agent, or Firm*—Michael M. Gnibus; Leon Nigohosian, Jr.

[57] ABSTRACT

A fluid pump with an improved manifold including a pump housing; an inlet manifold flow connected to the pump housing, the inlet manifold including an inlet manifold body, having a first end, a second end and an inlet manifold flow opening between the ends; and a discharge manifold flow connected to the pump housing at a location away from the inlet manifold, the discharge manifold including a discharge manifold body having a first end and a second end and a discharge manifold flow opening located between the ends, the discharge and inlet manifold flow openings each including a threaded portion and a flange for making either a threaded connection or flange connection with a flow conduit.

14 Claims, 5 Drawing Sheets

PUMP WITH IMPROVED MANIFOLD

FIELD OF THE INVENTION

This invention generally relates to fluid pumps and more particularly to an improved fluid pump having an inlet manifold or pump case and a discharge manifold or pump case each manifold or pump case having a flow opening that is adapted to make either a flange connection or a threaded connection with a flow conduit.

DESCRIPTION OF THE PRIOR ART

Fluid pumps such as centrifugal pumps, progressive cavity pumps, and diaphragm pumps for example, have an inlet flow opening through which a fluid is supplied to a pumping chamber, and a discharge flow opening through which the pumped fluid is discharged from the pump. A flow conduit, such as a pipe, for supplying a fluid to the pump is flow connected to the pump at the inlet flow opening, and a discharge flow conduit for flowing a pumped fluid from the pump is flow connected to the pump at the discharge flow opening. The fluid pumps include manifolds or pump cases and the flow openings are formed thereon. The flow openings include only a single means for connecting the flow conduit to the flow opening. For example, the flow openings may either be threaded in order to make a threaded connection with the flow conduit or may include a flange to make a flange connection with the flow conduit.

Since the inlet and discharge manifolds or pump cases include flow openings that either are adapted to make a threaded connection or are adapted to make a flange connection with the flow conduit it is frequently the case that the flow conduit and flow openings are not adapted to make the same type of connection. If the flow conduit and flow opening are not adapted for the same type of connection, either the flow opening or flow conduit must be adapted to a corresponding, type of connection. For example, if the flow conduit is adapted to make a threaded connection and the flow opening is adapted to make a flange connection, either the flow opening must be changed to a threaded connection or the conduit must be altered to make a flange connection. Such an alteration is made by bolting or otherwise connecting an adapter to either the end of the conduit or the flow opening.

Such an alteration requires additional parts, increases the pump downtime, and typically produces pump leakage at the connection between the adapter and flow conduit resulting in a less efficient pump.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid pump with an improvedflow connector, the pump including a pump housing; an inlet flow connector flow connected to the pump housing, the inlet flow connector including an inlet flow connector body, having a first end, a second end and an inlet flow opening between the ends; and a discharge flow connector flow connected to the pump housing at a location away from the inlet flow connector, the discharge flow connector including a discharge flow connector body having a first end and a second end and a discharge flow opening located between the ends, the discharge and inlet flow openings each including a threaded portion and a flange for making either a threaded connection or flange connection with a flow conduit.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 1:
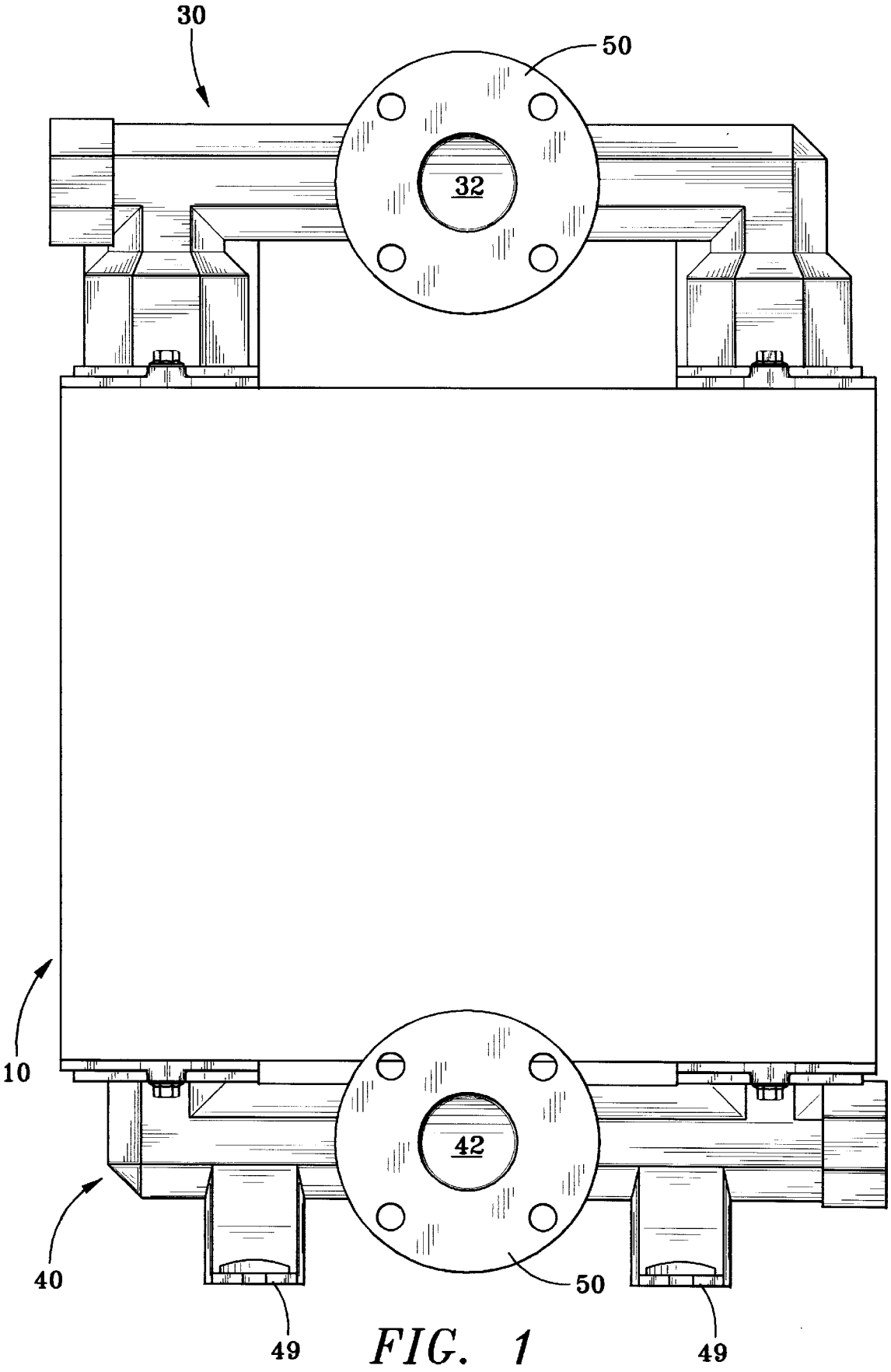
FIG. 1 is a schematic representation of a pump that includes the flow connectors of the present invention.

Referring now to the drawings, wherein similar reference characters designate corresponding parts throughout the several views, FIG. 1 schematically shows fluid pump 10 that is flow connected to improved inlet and discharge flow connectors 40 and 30 respectively. It should be understood that the term "flow connector" includes pump manifolds, pump cases or pump housings. For purposes of describing the preferred embodiment pump 11, the connectors will hereinafter be referred to as manifolds 30 and 40.

Additionally, it should be understood that pump 10 is represented generally in FIG. 1 since fluid pump 10 may be any fluid handling apparatus including any pump or compressor. However, for purposes of describing the preferred embodiment of the invention the fluid pump 10 will be a diaphragm pump, generally shown and indicated as 11 in FIG. 2.

Diaphragm pump 11 operates in a conventional manner well known to one skilled in the art, and with the exception of manifolds 30 and 40, is of conventional design.

Fluid pump 11 includes flanged body 12 that is adapted to support air motor 14. Bolted onto either side of the body 12 are first and second fluid end caps 16 and 18 respectively. The fluid end caps, in cooperation with body 12 form pump cavities which are divided into pumping and pressure chambers by corresponding flexible diaphragm members. The cavities, chambers and diaphragms are not shown in FIGS. 1–6, but are shown in detail in U.S. Pat. No. 5,108,270 which is incorporated herein by reference.

Figure 2:
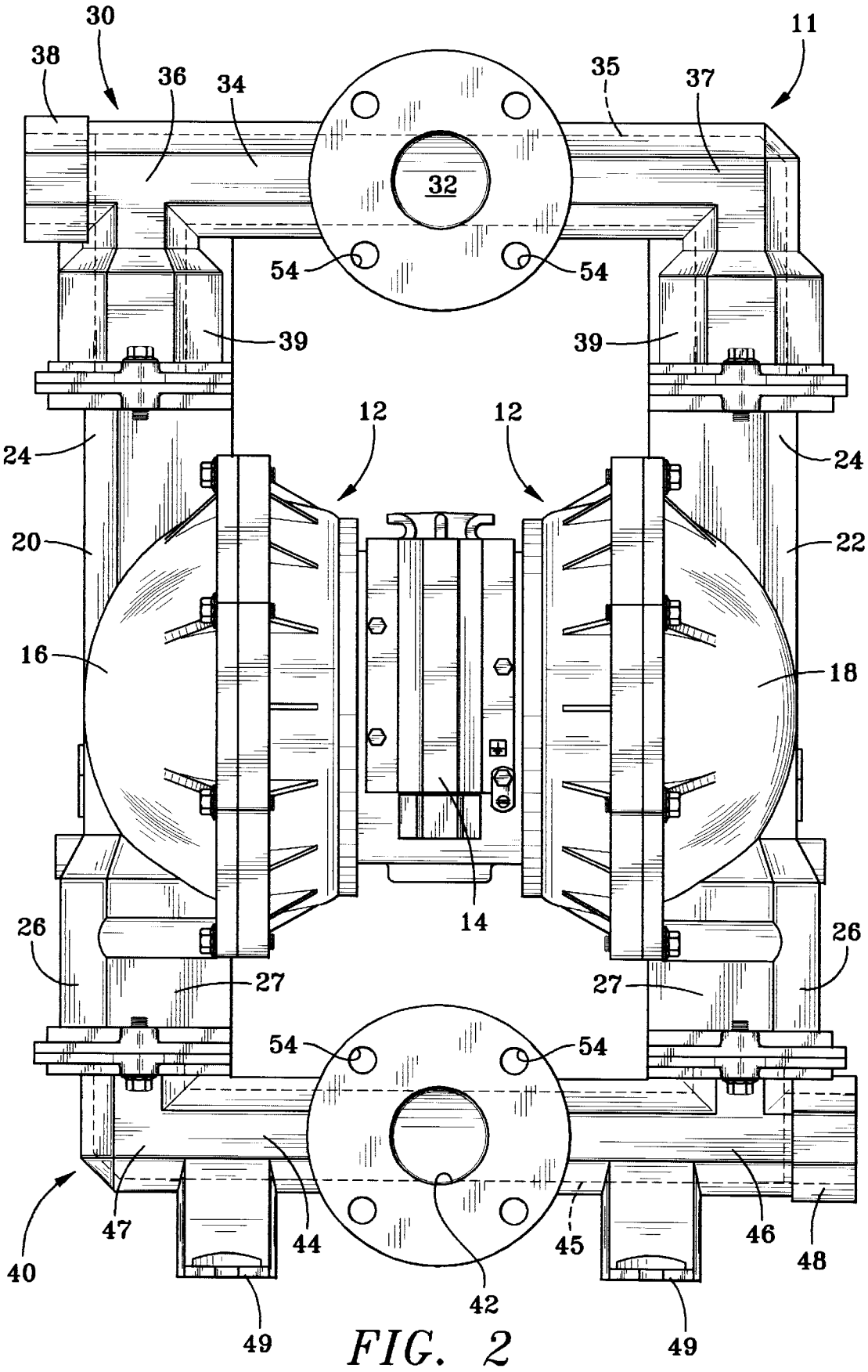
FIG. 2 is a front elevational view of a diaphragm pump that includes the manifolds of the present invention.

The fluid end caps 16 and 18 include respective integral conduits 20 and 22 that are in fluid communication with a respective cavity. Each conduit 20 and 22 has a discharge end 24 and an inlet end 26. As shown in FIG. 2, each of the inlet ends of conduits 20 and 22 includes a check valve housing 27 adapted to support a conventional flow check valve (not shown) which may be a ball-type check valve. The check valve is well known to one skilled in the art and does not form a part of the present invention.

Turning now to FIG. 2, inlet manifold 40 flow connects the pumping chambers to inlet flow opening 42 in manifold body 44, and discharge manifold 30 flow connects pumping chambers to discharge flow opening 32 provided in manifold body 34. Manifold 30 is bolted or otherwise connected to pump housing 12 at discharge ends 24 and manifold 40 is connected to the check valve housing 27 at the inlet ends 26.

The manifold bodies have first ends 36 and 46, and a second ends 37 and 47 opposite the first ends. The flow openings 32 and 42 are located between the first and second ends of the manifolds. Flow passages 35 and 45, shown in dashed lines in FIG. 2 extend through the manifold body and serve to flow connect flow openings 32, 42 with the first and second ends of the manifold body.

Figure 4:
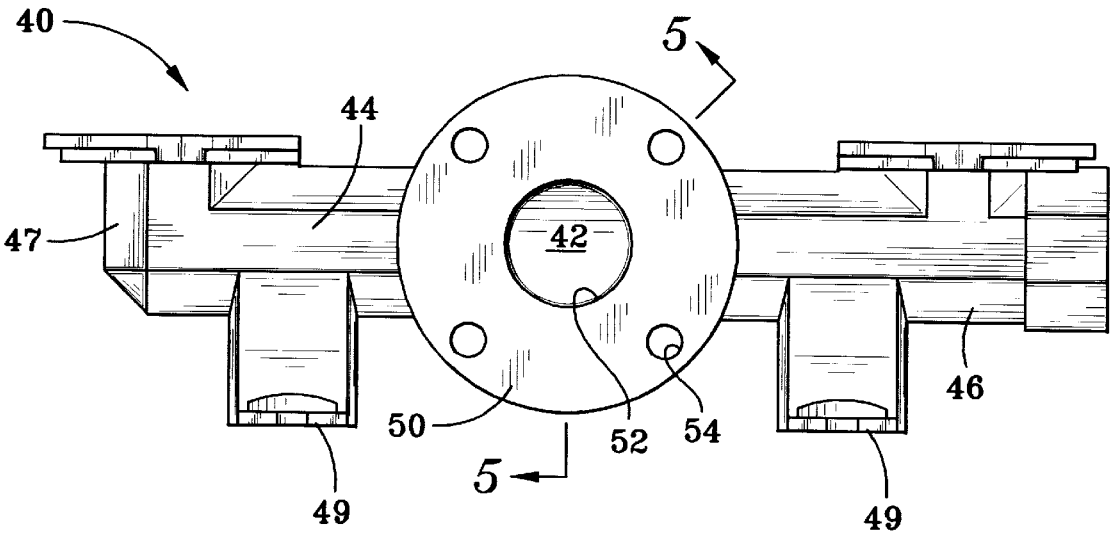
FIG. 4 is a front elevational view of the inlet manifold shown in FIG. 1.
Figure 5:
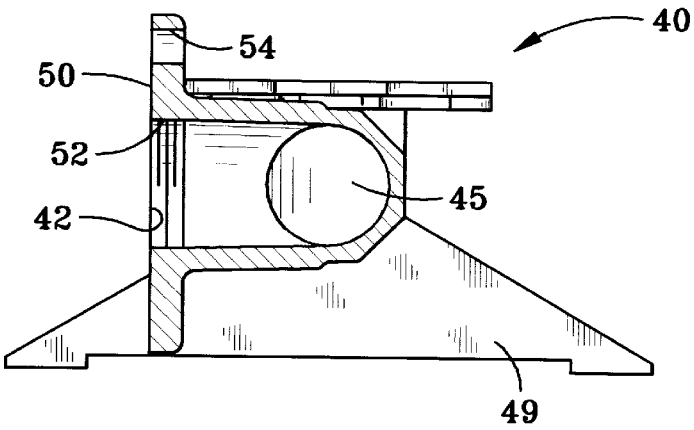
FIG. 5 is a sectional view taken along line 5—5 of FIG. 4.

As shown in FIGS. 2 and 4, manifold 40 includes two support feet 49 made integral with the manifold body. The feet support the fluid pump 11 when the pump is placed in the environment of use such as on a shelf or shop floor for example. It should be understood that manifold 40 may include any suitable number of feet and must include at least one support foot.

Figure 3A:
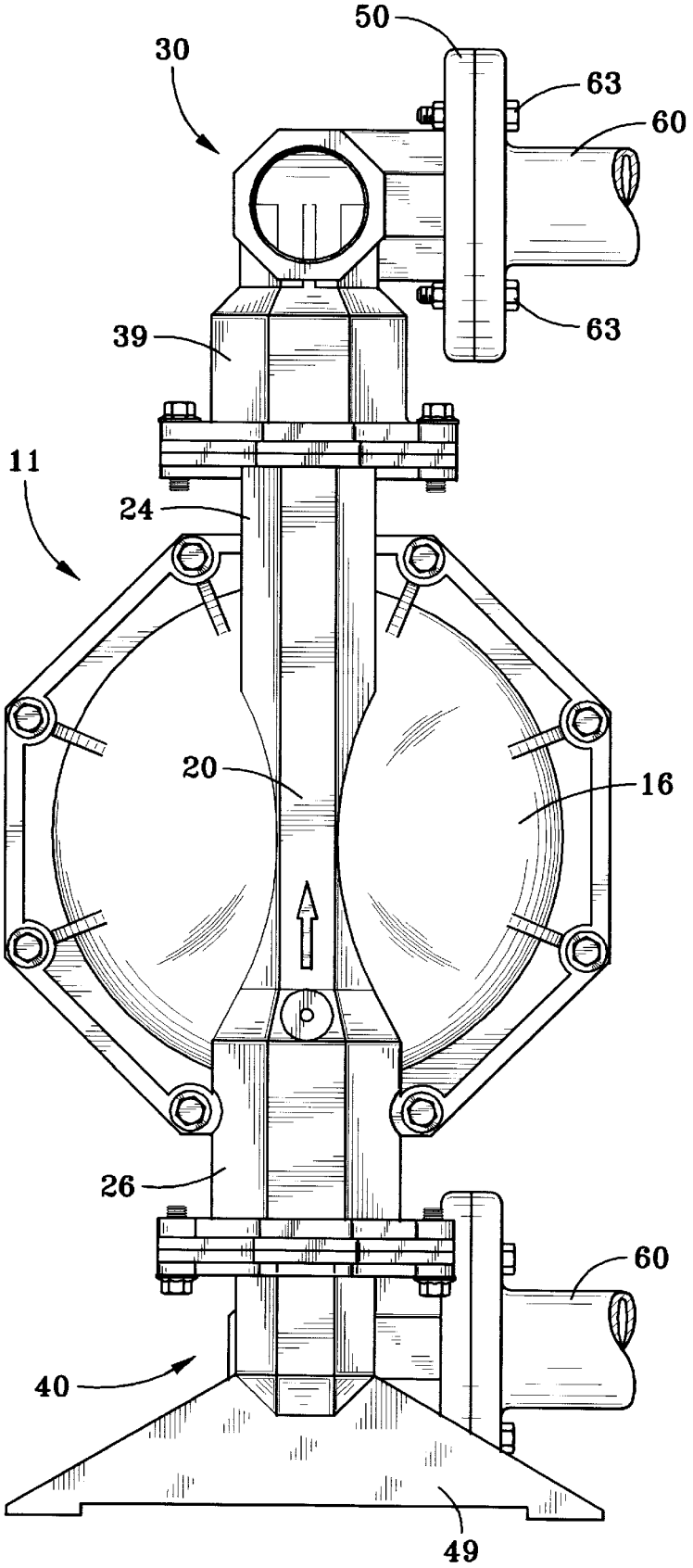
FIG. 3A is a side elevational view of the pump of FIG. 1 showing flange connections between the manifolds and flow conduits.
Figure 3B:
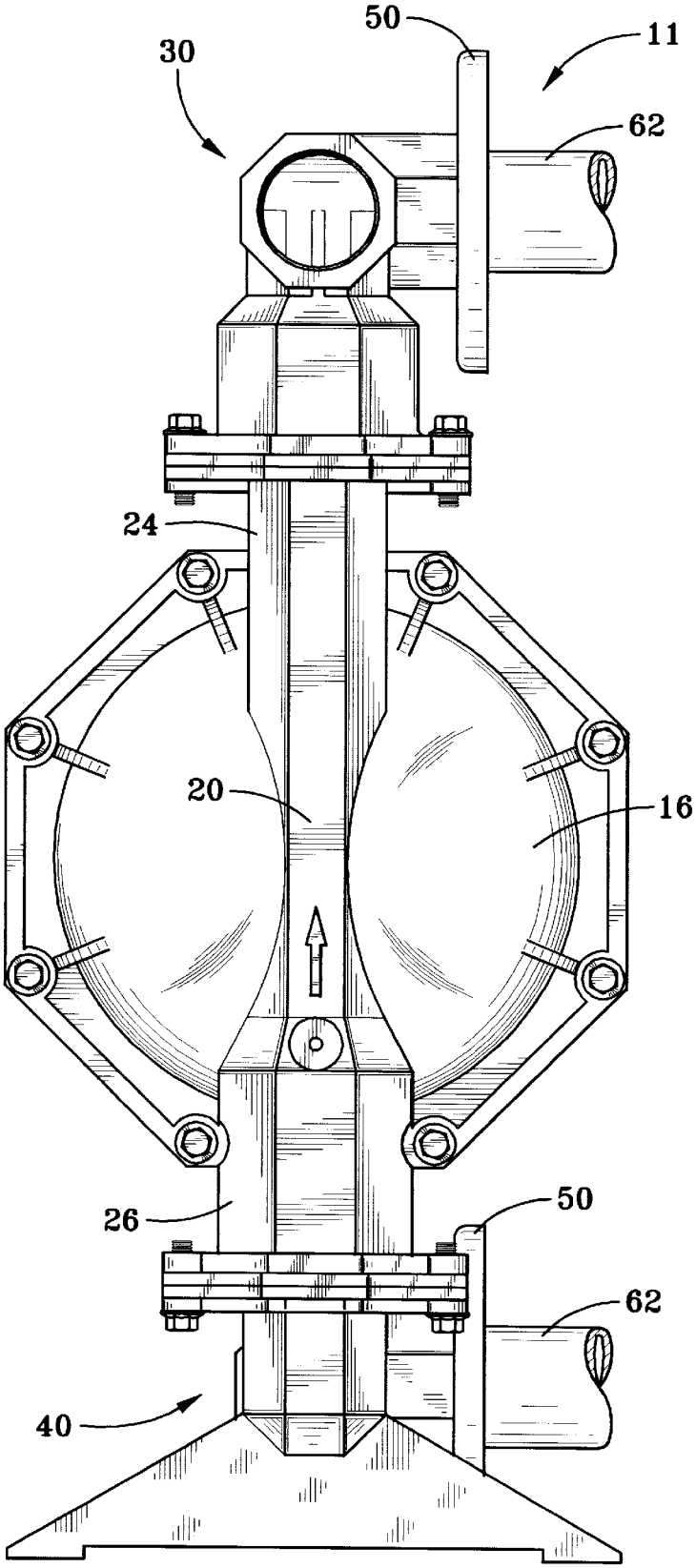
FIG. 3B is a side elevational view of the pump of FIG. 1 showing flow conduits threadably connected to the manifolds.

As shown in FIGS. 2, 3A and 3B, discharge manifold 30 includes a check valve housing 39 at each of the discharge manifold ends 36 and 37. Each of the valve housings is adapted to enclose a fluid flow check valve such as a conventional ball-type check valve in the same way the check valve housings 27 at the conduit ends 26 are adapted to support a fluid flow check valve.

Each manifold flow opening is adapted to make either a flange connection or a threaded connection with a flow conduit. The invention combines flange and threaded connection means at the flow openings and permits connection to the pump by either connection means. No adapter is required to connect a flow conduit to the pump 11 since a compatible threaded or flange connection means is available at the flow opening. Since attachment of an adapter is not required, down time is reduced, leaks are prevented and no extra parts are required to connect the flow conduit to the pump.

A flange 50 is made integral with each manifold body. The manifold body is manufactured by a casting process and the flange 50 is formed during the casting process. The flange may have any suitable dimensions however, the preferred flange conforms to ANSI or DIN standards.

After the manifold is cast, threads 52 are machined or otherwise formed along the manifold flow openings. The threads may be any suitable threads but are preferably conventional tapered threads such as NPTF or $BSP_T$ threads.

As shown in FIGS. 3A and 3B, the flanges are directed away from the same side of the pump. It should be understood that the flanged openings may be directed away from opposite sides of the pump. The flanges 50 include a plurality of openings 54 which are adapted to receive conventional fasteners such as bolts to flow connect to flow conduit and flange 50. In the preferred embodiment, four openings are provided in each flange.

FIG. 3A shows a flanged connection between fluid conduit 60 and flange 50. Bolts 63 serve to connect the flange of the flow conduit to the flange of the manifold. FIG. 3B shows a fluid conduit 62 threadably connected to flow openings 32 and 42.

Each manifold also includes a secondary flow opening 38, 48 formed at the first end of the manifold body. The secondary flow openings are typically plugged or otherwise closed during operation of the pump but may be opened and used in addition to flow openings 32 and 42 or in place of the flow openings.

Figure 6:
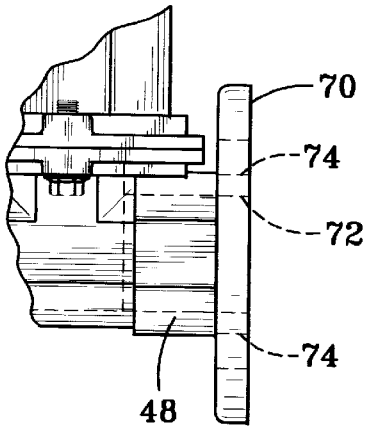
FIG. 6 is an alternate embodiment of the present invention showing an enlarged view of a portion of the pump shown in FIG. 1.

FIG. 6 shows an alternate embodiment of the present invention. As shown in FIG. 6, a flange 70 like flange 50 is formed at the secondary flow openings 38 and 48 and also a thread 72 is provided at each of the secondary openings. A plurality of connector openings 74 like openings 54 are included in the flange 70. Like the flange 50 and thread 52, the flange/thread combination at the secondary opening permits the flow conduit to be connected to the pump using either connection means and no adapter apparatus is required.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A fluid pump comprising:

a) a pump housing containing means for pumping a fluid;

b) an inlet manifold flow connected to the pump housing, the inlet manifold including an inlet manifold body, having a first end, a second end and an inlet manifold flow opening between the ends; and c) a discharge manifold flow connected to the pump housing at a location away from the inlet manifold, the discharge manifold including a discharge manifold body having a first end and a second end and a discharge manifold flow opening located between the ends, the discharge and inlet manifold flow openings each including a threaded connection means and a flange connection means for selectively making either a threaded connection or flange connection with a flow conduit.

2. The pump as claimed in claim 1 wherein the inlet and discharge manifolds each include a second flow opening that includes a threaded connection means and a flange connection means for selectively making either a threaded connection or flange connection with a flow conduit.

3. The pump as claimed in claim 1 wherein the inlet manifold includes at least one support foot.

4. The pump as claimed in claim 1 wherein the discharge manifold includes check valve housings at the ends of the manifolds adapted to be connected to the pump housing.

5. The pump as claimed in claim 1 wherein the pump is a diaphragm pump.

6. The pump as claimed in claim 1 wherein the pump is a centrifugal pump.

7. A pump connector comprising a body having a pair of ends, a flow opening between the ends, said flow opening including a threaded connection means and a flange connection means for selectively forming either a threaded connection between the connector and a threaded flow conduit or a flange connection between the connector and a flanged flow conduit.

8. The pump connector as claimed in claim 7 wherein the connector is manufactured by a casting process.

9. The pump connector as claimed in claim 7 wherein the threaded connection means conforms to NPTF standards.

10. The pump connector as claimed in claim 7 wherein the threaded connection means conforms to $BSP_T$ standards.

11. The pump connector as claimed in claim 7 wherein the flange conforms with ANSI standards for flanges.

12. The pump connector as claimed in claim 7 wherein the flange conforms with DIN standards for flanges.

13. The pump connector as claimed in claim 7 wherein the connector includes at least one support foot.

14. A fluid pump comprising:

a) a pump housing containing means for pumping a fluid;

b) an inlet flow connector flow connected to the pump housing, the inlet flow connector including an inlet flow connector body, having a first end, a second end and an inlet flow opening between the ends; and c) a discharge flow connector flow connected to the pump housing at a location away from the inlet flow connector, the discharge flow connector including a discharge flow connector body having a first end and a second end and a discharge flow opening located between the ends, the discharge and inlet flow openings each including a threaded connection means and a flange connection means for selectively making either a threaded connection or flange connection with a flow conduit.

* * * * *